United States Patent [19]

Wright

[11] 4,025,751

[45] May 24, 1977

[54] FUSER ROLL SLEEVE

[75] Inventor: Bertsel O. Wright, Rochester, N.Y.

[73] Assignee: Xerox Corporation, Stamford, Conn.

[22] Filed: Apr. 28, 1975

[21] Appl. No.: 572,695

[52] U.S. Cl. ..... 219/216; 29/447; 219/469; 432/60

[51] Int. Cl.[2] ..... H05B 1/00; G03G 15/20

[58] Field of Search ..... 219/216, 469–471; 432/60, 228; 264/330, 249; 29/447; 100/93 RP

[56] References Cited

UNITED STATES PATENTS 3,751,216 8/1973 Gregory ..... 219/469 X

*Primary Examiner*—C. L. Albritton

[57] ABSTRACT

For use in a xerographic reproducing apparatus, a fuser roll structure comprising a core member having a sleeve carried thereby and a heat source disposed internally or externally of the core member. The fuser roll structure is characterized by the fabrication process wherein the sleeve is elevated in temperature above the operational temperature of the fuser roll structure and/or the core is chilled below ambient or room temperature. The sleeve is then installed on the core, and the assembly allowed to return to normal room temperature thereby creating a secure shrink fit of the sleeve onto the core. Structurally, the fuser roll comprises a sleeve the inside diameter of which is slightly larger than the outside diameter of the core when the sleeve temperature is elevated above said operational temperature and/or the core is chilled below said room or ambient temperature. At the operating temperature or below the aforementioned shrink fit exists. The process is also suitable for the fabrication of other types of roll structures for employment in a xerographic reproducing apparatus, for example, transport rolls which move the copy paper through the apparatus.

3 Claims, 2 Drawing Figures

FUSER ROLL SLEEVE

BACKGROUND OF THE INVENTION

This invention relates in general to the fixing of developed latent electrostatic images on a substrate, and more particularly, to apparatus for obtaining the desired permanent bonding of toner material, employed for development purposes in a xerographic copying machine, to the substrate.

In an automatic xerographic process of a type familiar to those skilled in the art and exemplified by U.S. Pat. No. 3,062,108, issued in the name of Clyde R. Mayo, the utilization of a heated fixing mechanism for achieving the permanent bonding of the developed latent electrostatic image onto the copy medium has proven highly satisfactory. One such fixing mechanism is commonly referred to as a fuser roll assembly. The fuser roll assembly additionally functions to feed the copy medium, such as paper, through the transfer station of the typical xerographic process. In providing the foregoing function, the fuser roll assembly cooperates with a backup roll. An example of such fuser roll assembly is disclosed in U.S. Pat. No. 3,291,466 issued to Aser et al.

In a typical construction of a fuser roll assembly, a hollow, generally cylindrical roll is mounted for rotation about its longitudinal axis, and is provided, along this axis, with an electric heating element. Such a roll is usually constructed of copper or aluminum and is normally provided with a coating of a suitable thermoplastic material, for example, polytetrofluoroethylene (hereinafter referred to as PTFE). PTFE is a fluorocarbon resin currently sold under the trademark "Teflon" by the E. I. duPont de Nemours and Company, Inc.

In operation, fuser roll assemblies are subjected to relatively high temperatures and pressures and this, together with manufacturing difficulties in obtaining perfect adhesion of the PTFE to the surface of the assembly roll, is the cause of deterioration of the PTFE coating which makes the roll unsatisfactory for continued use, thus necessitating its replacement. Where the roll is formed of copper, the roll is returned from the field, the PTFE being thereafter machined off (PTFE being almost chemically inert cannot be stripped easily without machining back to the base material). This machining operation causes loss of diameter beyond diameter tolerances, so the roll is deliberately machined slightly below true diameter and then built up oversize again, as by spraying with aluminum. The roll is then machined again to true diameter, and coated with PTFE as an original roll. This is a costly and tedious process.

When the roll is formed of aluminum, which is less expensive than copper, it is found economical to discard the aluminum rolls entirely when they can no longer be satisfactorily employed in copying machines. New roll assemblies are then substituted for the discarded assemblies. The difference in initial material costs plus the elimination of shipping costs from the field to the fuser assembly renovation site approximates the cost of repairing fuser roll assemblies including copper rolls. It is apparent that neither of these repair methods for fuser roll assemblies is satisfactory.

SUMMARY OF THE INVENTION

It is therefore an object of the invention to provide fuser roll assemblies that may be readily repaired at minimal cost.

It is a further object of the invention to provide a fuser roll assembly that may be repaired at centralized field locations in lieu of returning the assembly to the place of manufacture.

It is a further object to provide a fuser roll assembly that is less expensive to manufacture and to repair, and one that will require less maintenance.

These and other objects of the invention are obtained by forming the fuser roll assembly in a unique manner.

The assembly or fuser roll structure in accordance with the invention includes a cylindrical roll, which functions as the assembly core member having an electrical heating element preferably disposed internally thereof and along its longitudinal axis. A substantially cylindrical sleeve or shell member is slidably mounted about the core while its temperature is elevated and/or the core is chilled. The sleeve-core assembly is thereafter allowed to cool to room temperature at which time the inside diameter of the sleeve tends to be slightly less than the outside diameter of the core member. It will be appreciated that a secure fit between the two members is thus created.

With the foregoing procedure, minimum equipment and process steps are required as compared to known processes. Consequently, the repair of such fuser roll structures or assemblies can economically be accomplished at centralized field locations in lieu of returning them to a single location such as the place of manufacture.

By employing the fuser roll assembly of the present invention, when the shell is worn or otherwise rendered unsuitable for further use, it may be removed by such means as slitting the sleeve on opposite sides along its entire length thereby allowing the sleeve halves, thus formed, to be removed and thereafter discarded. A new shell or sleeve at the required temperature may then be positioned concentrically about the core at the required temperature and spaced apart from the core, the sleeve-core assembly being allowed to return to operating temperature or below, thus creating the aforementioned secure fit between the sleeve and core.

Other objects of the invention and further features thereof shall become apparent to those skilled in the art in view of the following detailed disclosure and description of a preferred embodiment of the invention, particularly when read in conjunction with the accompanying drawings.

DETAILED DESCRIPTION OF THE DRAWINGS

Figure 1:
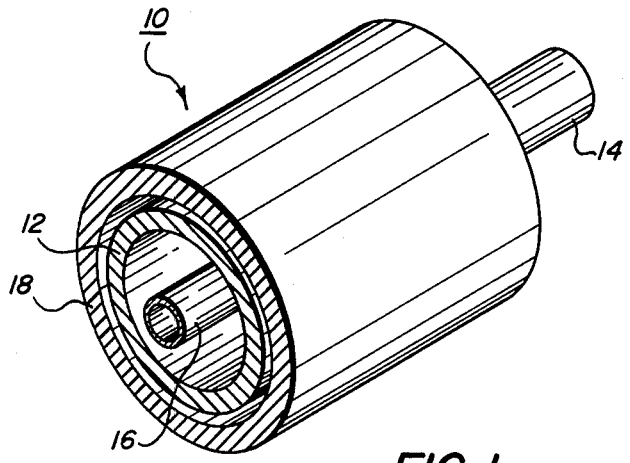
Figure 2:
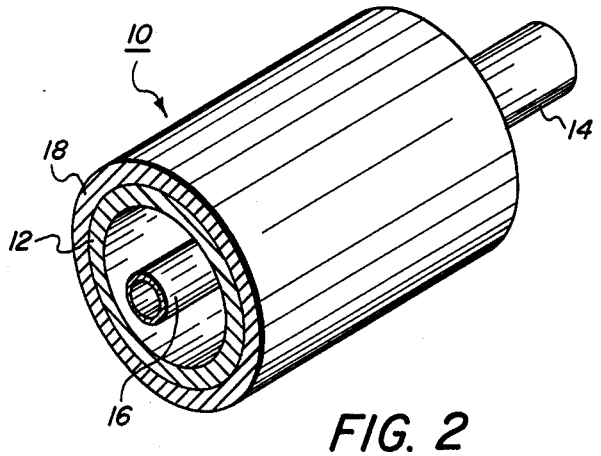

FIG. 1 is a perspective view of a fuser roll structure or assembly prior to the sleeve member being shrunk-fit onto a core member; and FIG. 2 is a perspective view of the fuser roll assembly or structure as contemplated by the present invention with the sleeve shrunk-fit onto the core.

DETAILED DESCRIPTION OF THE PREFERRED EMBODIMENT

Since the xerographic reproducing process is well-known, a detailed description thereof is omitted. For those considering a description of the xerographic process necessary before a complete understanding of the present invention, reference may be had to U.S. Pat.

Nos. 3,718,116 and 3,745,972 which patents are incorporated herein by reference.

FIGS. 1 and 2 of the drawings illustrate a fuser roll assembly or structure 10 which is adapted to be utilized in a xerographic reproducing apparatus for fusing toner images to copy paper. The assembly 10 comprises a hollow core or roll 12 of cylindrical shape preferably fabricated from copper material and adapted to be mounted for rotation about its longitudinal axis by means of stainless steel hub portions 14 (only one of which is shown). The core may have an outside diameter on the order of 2⅞ inches.

In one embodiment contemplated by the present invention, a resistance heating element 16 is disposed internally of the core and is co-extensive with the longitudinal axis thereof. The resistance heating element may be energized when desired by actuation of suitable means (not shown) as for example a switch connects element 16 to a source of electrical power (also not shown).

A hollow cylindrical shell or sleeve 18, preferably formed of aluminum material is shrunk-fit onto the core 12 by elevating the temperature of the sleeve to a temperature of about 700° F. and inserting the core 12 into the sleeve and allowing the sleeve to cool to room temperature thereby effecting the shrink fit of the sleeve onto the core 12. The outside diameter of the sleeve may have a nominal dimension of three inches. While the sleeve 18 preferably comprises a bare sleeve of aluminum material a coating of PTFE may be applied to the surface thereof.

At room temperature, the inside diameter of the sleeve is slightly less than the outside diameter of the core 12. However, when elevated to a temperature of 700° F. as by placing in a suitable oven for a sufficient period of time the sleeve 18 expands such that the inside diameter thereof is slightly greater (See FIG. 1) than the outside diameter of the core 12. Upon cooling (FIG. 2) the sleeve 18 becomes shrunk-fit onto the core 12.

While the heating element 16 is described as a resistance heating element disposed internally of the core 12 the means for elevating the temperature of the fuser roll structure during operation may comprise an external source such as radiant heating element of the type disclosed in U.S. Pat. No. 3,498,596, incorporated herein by reference. The surface temperature of the sleeve may also be elevated by other suitable energy sources, for example, microwave or induction. An alternative for raising the sleeve temperature would be to provide the sleeve with an electrically resistive coating through which an electrical current could be passed during the fusing operation. When the sleeve is externally heated as disclosed, the core 12 may be fabricated from materials other than copper and may be fabricated from certain insulating materials suitable for providing a rigid cylindrical configuration.

Those skilled in the art will recognize that the foregoing illustrative embodiment of the invention represents but a single embodiment and various modifications can be made to the apparatus without departing from the spirit of the inventive concept. Accordingly, the scope of protection set by Letters Patent is to be defined solely by the appended claims.

What is claimed is:

1. Fuser apparatus for use in reproducing apparatus, including:

an elongated rigid core member having a generally circular cross section adapted to be mounted for rotation about its longitudinal axis;

a sleeve member having an inside diameter slightly greater than the outside diameter of said core when the temperature of said sleeve is elevated above the operational temperature of said fuser apparatus and/or the core is chilled below ambient temperature and wherein the outer surface of said rigid core securely engages the inner surface of said sleeve when the sleeve-core assembly is at or below operating temperature and means for elevating the temperature of said sleeve member whereby toner images supported on substrates are softened when they are contacted by said sleeve.

2. Apparatus according to claim 1 wherein the outer surface of said sleeve is coated with a fluorocarbon resin.

3. Apparatus according to claim 2 wherein said means for elevating the temperature of said sleeve comprises a heater disposed internally of said core member.

* * * * *